US010293474B2

(12) United States Patent
Wiedner et al.

(10) Patent No.: US 10,293,474 B2
(45) Date of Patent: May 21, 2019

(54) SIDE HANDLE

(71) Applicant: HILTI AKTIENGESELLSCHAFT, Schaan (LI)

(72) Inventors: Aaron Wiedner, Landsberg (DE); Thomas Bader, Landsberg am Lech (DE); Thomas Hofbrucker, Mammendorf (DE); Jerome Jaromin, München (DE); Hüseyin Cicekci, Rosenheim (DE)

(73) Assignee: HILTI AKTIENGESELLSCHAFT, Schaan (LI)

( * ) Notice: Subject to any disclaimer, the term of this patent is extended or adjusted under 35 U.S.C. 154(b) by 74 days.

(21) Appl. No.: 15/522,399

(22) PCT Filed: Nov. 3, 2015

(86) PCT No.: PCT/EP2015/075533
§ 371 (c)(1),
(2) Date: Apr. 27, 2017

(87) PCT Pub. No.: WO2016/071313
PCT Pub. Date: May 12, 2016

(65) Prior Publication Data

US 2017/0312904 A1 Nov. 2, 2017

(30) Foreign Application Priority Data

Nov. 4, 2014 (EP) ..... 14191606

(51) Int. Cl.
*B25F 5/00* (2006.01)
*B25F 5/02* (2006.01)

(52) U.S. Cl.
CPC ..... *B25F 5/026* (2013.01); *B25F 5/003* (2013.01)

(58) Field of Classification Search
CPC ..... B25F 5/026; B25F 5/003
(Continued)

(56) References Cited

U.S. PATENT DOCUMENTS 4,256,422 A * 3/1981 Theissig ..... B23B 49/006 173/21
4,881,294 A 11/1989 Riedl
(Continued)

FOREIGN PATENT DOCUMENTS

CN 1695853 A 11/2005
CN 201841532 U 6/2011
(Continued)

OTHER PUBLICATIONS

European Patent Office, European Search Report in European Application No. 14 19 1606, dated Apr. 17, 2015.
(Continued)

*Primary Examiner* — Hadi Shakeri
(74) *Attorney, Agent, or Firm* — Leydig Voit & Mayer

(57) ABSTRACT

A rail has a guide surface on which the locking block is guided in a bearing manner between a position locking the bar, in which the toothed side engages in the toothed long side, and an unlocked position, in which the toothed side is not engaged with the toothed long side. A spring pretensions the locking block into the locking position. The guided side and/or the guide surface have a flank that is inclined with respect to the bar axis such that the locking block is forced in the direction of the bar in the event of a movement along the bar axis.

4 Claims, 2 Drawing Sheets

(58) Field of Classification Search
USPC ..... 81/489
See application file for complete search history.

(56) References Cited

U.S. PATENT DOCUMENTS

| | | | | |
|---|---|---|---|---|
| 2002/0159847 | A1 | 10/2002 | Wanek et al. | |
| 2011/0131766 | A1 | 6/2011 | Imaschewski et al. | |
| 2013/0028678 | A1* | 1/2013 | Arich | B25F 5/026 408/241 S |

FOREIGN PATENT DOCUMENTS

| | | | |
|---|---|---|---|
| CN | 203792286 | U | 8/2014 |
| EP | 0 132 593 | A2 | 2/1985 |
| EP | 2 332 696 | A2 | 6/2011 |
| EP | 2 551 065 | A2 | 1/2013 |

OTHER PUBLICATIONS

International Bureau, International Search Report in International Application No. PCT/EP2015/075533, dated Feb. 12, 2016.

* cited by examiner

SIDE HANDLE

CROSS-REFERENCE TO RELATED APPLICATIONS

This patent application is the U.S. National Stage of International Patent Application No. PCT/EP2015/075533, filed Nov. 3, 2015, which claims the benefit of European Patent Application No. 14191606.4, filed Nov. 4, 2014, which are each incorporated by reference.

FIELD OF THE INVENTION

The present invention relates to a removable side handle for a handheld power tool, for example, an electric screwdriver or a hammer drill. The side handle has a rod acting as a depth stop, which projects over the side handle in the working direction. The user may move the rod in the side handle along the working direction and subsequently lock the rod.

The rod is to be simply movable and at the same time securely lockable.

DISCLOSURE OF THE INVENTION

The side handle has a handle bar and a head for attaching the side handle at a handheld power tool. A rod has a toothed longitudinal side parallel to the rod axis. The rod is movable in a holder along the rod axis. A locking block has a toothed side facing the toothed longitudinal side of the rod, and the locking block has a guided side facing away from the toothed side. A hollow rail has a guide surface at which the locking block is abuttingly guided between a position locking the rod, in which the toothed side engages in the toothed longitudinal side, and an unlocked position, in which the toothed side does not engage with the longitudinal side. A spring pretensions the locking block in the locking position. The guided side or the guide surface or both surfaces have at least one flank inclined with respect to the rod axis in such a manner that the locking block in a movement along the rod axis is forced in the direction of the rod.

The locking block is pushed by the inclined flank toward the rod if the rod moves. The engagement of the teeth increases under an axial load on the rod.

BRIEF DESCRIPTION OF THE FIGURES

The subsequent description explains the present invention on the basis of exemplary embodiments and figures.

In the drawing.

The same or functionally equivalent elements are identified by the same reference characters in the figures, unless otherwise indicated.

EMBODIMENTS OF THE INVENTION

Figure 1:
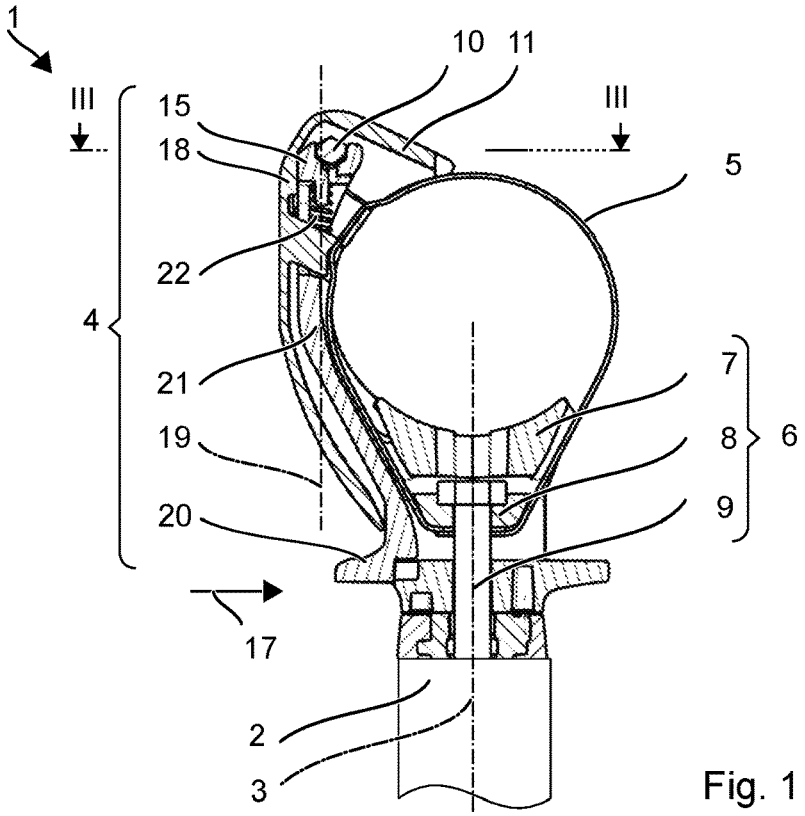
FIG. 1 shows a side handle having a locked depth stop.

FIG. 1 shows an exemplary side handle 1 having an integrated depth stop for a drill or another handheld power tool. Side handle 1 has a handle bar 2 which is cylindrically formed or, for an ergonomic design, formed in a bulge-shaped manner. Handle rod 2 is largely rotationally symmetrical with respect to handle axis 3. Side handle 1 has a head 4, by which side handle 1 may be attached to the drill without using tools. Head 4 is disposed at one end of handle rod 2, preferably lying on handle axis 3. Exemplary head 4 includes a loop-shaped tensioning belt 5 and a tensioning mechanism 6. Tensioning mechanism 6 is tightened about handle axis 3 by rotating handle rod 2. The illustrated tensioning mechanism 6 is based on an inner clamping jaw 7 and an outer clamping jaw 8, which are both disposed within tensioning band 5. A threaded rod 9 anchored in handle rod 2 spreads two clamping jaws 7, 8 apart when rotating handle rod 2. The head may also be configured in manifold ways. For example, the head may have two clamps which may engage around the housing of the drill.

The depth stop is based on a rod 10 locked in a holder 11. Holder 11 is mounted at head 4 in such a manner that rod 10 by its rod axis 12 is oriented substantially parallel to the working direction of the drill. Rod 10 approaches the substrate or the workpiece as the drilling progresses and eventually strikes the substrate or workpiece. Handle axis 12 is typically perpendicular to handle axis 3.

Exemplary rod 10 has a polygonal cross section, for example, a hexagonal cross section. One or two longitudinal sides 13 are provided with toothing. The toothing is perpendicular to rod axis 12, that is, the head lines of the individual teeth of the toothing run perpendicular to rod axis 12.

Holder 11 accommodates rod 10. Exemplary holder 11 has two through holes 14, the cross sections of which correspond to the cross section of rod 10. Rod 10 is movably guided in holder 11 along its rod axis 12. The user may move rod 10 along rod axis 12, that is, along the working axis of the drill, in accordance with the desired axial distance of a rod tip to a drill head.

A locking of rod 10 along rod axis 12 is carried out by a movable locking block 15. Locking rod 15 has a toothed side 16. The toothing of toothed side 16 is formed as a counter piece to the toothing on longitudinal side 13 of rod 10. Locking block 15 may engage in rod 10 in a meshing manner. The teeth oriented perpendicular to rod axis 12 constrain rod 10 along rod axis 12. Toothed side 16 points in a direction which is subsequently referred to as mesh direction 17.

Figure 2:
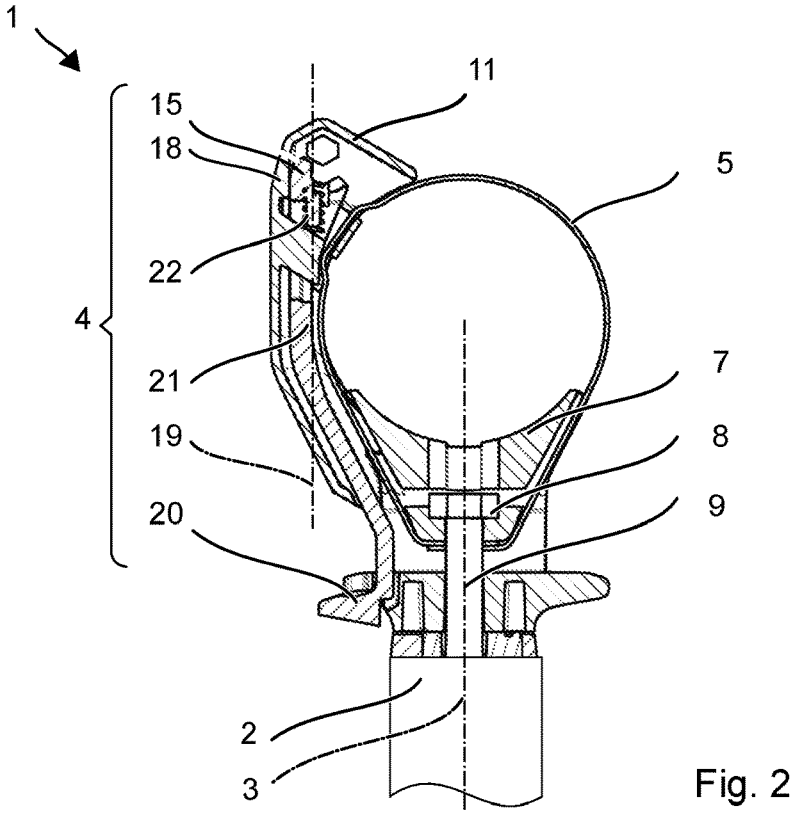
FIG. 2 shows the side handle having an unlocked depth stop.
Figure 3:
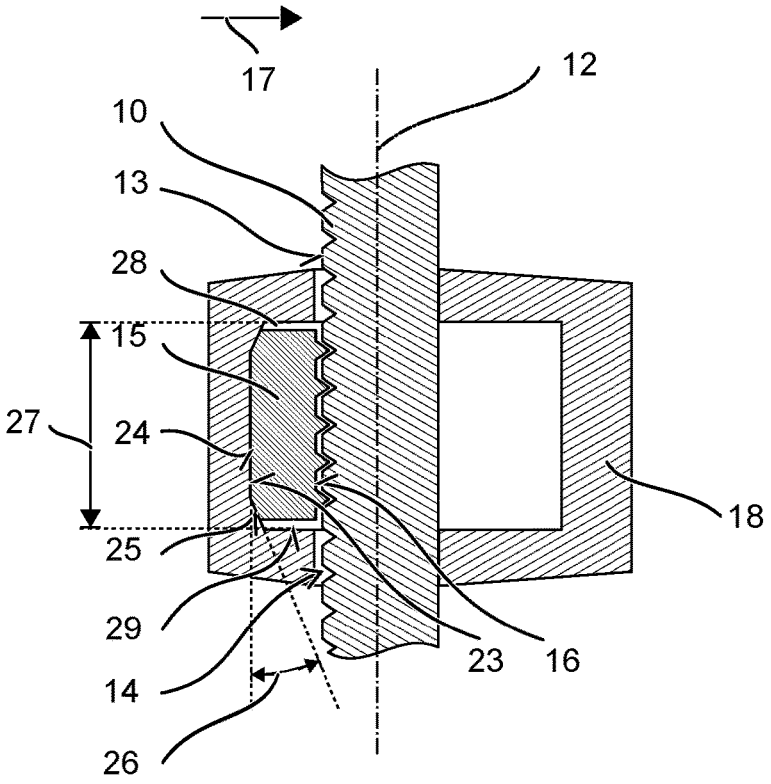
FIG. 3 shows a section in the plane 111-111.

Locking block 15 is movably guided in a hollow rail 18 alongside a guide axis 19. Guide axis 19 is, for example, parallel to handle axis 3. A knob 20 is connected to locking block 15 via a rigid pull rod 21. The user may pull locking block 15 from the locking position shown in FIG. 1 into an unlocked position shown in FIG. 2. Toothed side 16 of locking block 15 in the unlocked position is not engaged with longitudinal side 13 of rod 10 and, as a result, rod 10 may be moved in holder 11 along its rod axis 12. A spring 22 pushes locking block 15 in the locking position. Rod 10 is locked without influence of the user and immobile along rod axis 12.

On the one hand, the user should be able to pull locking block 15 with little effort out of the engagement with rod 10; however, on the other hand, locking block 15 is to hold rod 10 locked even in the case of a large force acting axially on rod 10. This is achieved by the guidance of locking block 15. Locking block 15 has a guided side 23 abutting at a guide surface 24 of hollow rail 18. Locking block 15 by its guided side 23 slides, abutting at guide surface 24, along guide axis 19 between the locking position and the unlocked position. Guided side 23 is facing away from toothed side 16. Locking block 15 is pushed laterally by its toothing onto the toothing of rod 10. The flanks and head lines of the teeth are parallel to guide axis 19. Mesh direction 17 of locking block 15 is perpendicular or largely perpendicular to guide axis 19. If an axial force acts upon rod 10 along rod axis 12, a force component results in the meshing along meshing direction 17, which pushes the mesh apart. Locking block 15 is braced by guided side 23 at guide surface 24 against this force component and prevents an opening of the mesh.

Rod 10 and holder 11 have play between each other. Aside from unavoidable manufacturing tolerances, a play is useful so that rod 10 is easily insertable into holder 11. The difference in diameter of through holes 14 to the diameter of rod 10 adds to the play. The depth of the mesh is greater than the play, as a result of which a securely meshed engagement results in the locked position. The engagement of the teeth may, however, have an overlap too small to resist the force when rod 10 strikes the substrate. The guide increases the engagement when rod 10 moves along rod axis 12. Locking block 15 has a flank 25 inclined in relation to rod axis 12. Flank 25 abuts advantageously at an equally inclined flank of guide surface 24. Inclination 26 of flank 25 vis-à-vis rod axis 12, for example, is in the range between 10 degrees and 30 degrees. The dimension of flanks 25 along rod axis 12 is in the range between 1 mm and 2 mm. Preferably, inclination 26 is less than half the size of the inclination of the teeth of toothed side 16 vis-à-vis rod axis 12. Locking block 15 is movable along rod axis 12. A width 27 of the hollow profile of rail 18 is slightly greater than the width of locking block 15. A gap 28 along rod axis 12 between locking block 15 and sections 29 of rail 18 perpendicular to rod axis 12 is approximately half the size to twice the size of the tooth pitch of the toothing of toothed side 23. If rod 10 moves along rod axis 12, locking block 15 is entrained. Locking block 15 is pushed by its inclined flank 25 toward rod 10. The toothing of locking block 15 then engages deeper in the toothing of rod 10.

The invention claimed is:

1. A side handle comprising a handle bar, a head for attaching the side handle to a handheld power tool, a rod having a rod axis and a toothed longitudinal side parallel to the a rod axis, a holder in which the rod is movable along the rod axis, a locking block, which has a toothed side facing the toothed longitudinal side of the rod and a guided side facing away from the toothed side, a rail having a guide surface, at which the locking block is abuttingly guided along a guide axis by the guided side between a locking position locking the rod, in which the toothed side engages in the toothed longitudinal side and an unlocked position, in which the toothed side does not engage with the toothed longitudinal side, a pull rod connected to the locking block, the pull rod having a portion extending along a direction that is substantially parallel to the guide axis, the pull rod for moving the locking block from the locking position into the unlocked position, and a spring, which pretensions the locking block in the locking position, wherein the guided side and/or the guide surface has/have a flank inclined with respect to the rod axis such that during a movement along the rod axis the locking block is forced in a the direction of the rod.

2. The side handle as recited in claim 1, wherein the flank has an inclination between 10 degrees and 30 degrees vis-a-vis the rod axis.

3. The side handle as recited in claim 2, having a mesh direction, wherein the locking block is guided along the guide axis between the locking position and the unlocked position, and the mesh direction of the locking block is perpendicular to the guide axis or is at an angle between 75 degrees and 90 degrees with respect to the guide axis.

4. The side handle as recited in claim 1, having a mesh direction, wherein the locking block is guided along the guide axis between the locking position and the unlocked position, and the mesh direction of the locking block is perpendicular to the guide axis or is at an angle between 75 degrees and 90 degrees with respect to the guide axis.

* * * * *